US005739096A

United States Patent [19]

Rees

[11] Patent Number: 5,739,096

[45] Date of Patent: Apr. 14, 1998

[54] CYANOPYRIDINE N-OXIDE PEROXIDE BLEACH ACTIVATORS

[75] Inventor: Wayne M. Rees, Racine, Wis.

[73] Assignee: S. C. Johnson & Son, Inc., Racine, Wis.

[21] Appl. No.: 643,811

[22] Filed: May 6, 1996

[51] Int. Cl.[6] ..... C11D 3/395

[52] U.S. Cl. ..... 510/376; 252/186.39; 510/500; 510/503

[58] Field of Search ..... 252/186.39; 510/375, 510/376

[56] References Cited

U.S. PATENT DOCUMENTS 5,532,370 7/1996 Henrie, II et al. ..... 544/279

FOREIGN PATENT DOCUMENTS

165286 B1 12/1994 Poland .

OTHER PUBLICATIONS

L. Kaczmarek, R. Balicki, P. Nanta-Namirski, Chemische Berichte 1992, vol. 125, pp. 1965–1966 (Abstract), Apr. 1992.

*Primary Examiner*—Margaret Einsmann
*Assistant Examiner*—John R. Hardee
*Attorney, Agent, or Firm*—Laura L. Bozek

[57] ABSTRACT

Disclosed herein are bleaching systems that contain a peroxide and an activator. The activator is a cyanopyridine N-oxide, preferably 2, 3, or 4-cyanopyridine N-oxide. The peroxide is preferably hydrogen peroxide. When such bleaching systems are utilized in an aqueous alkaline environment, they provide bleaching performance on a variety of stains on both hard and soft surfaces.

9 Claims, 2 Drawing Sheets

CYANOPYRIDINE N-OXIDE PEROXIDE BLEACH ACTIVATORS

TECHNICAL FIELD

The present invention relates to cleaning compositions that contain peroxide. These compositions can be used to bleach organic stains from various surfaces.

BACKGROUND ART

Peroxides are known bleaching agents. They can be supplied as hydrogen peroxide itself, or as other forms of peroxides such as alkyl hydroperoxides (an example of which is t-butyl hydroperoxide), persulfate bleaches (e.g. monopersulfate such as Dupont's OXONE), or by using a hydrogen peroxide "generator" such as a perborate, a percarbonate, a peroxyurea compound, persilic acid and hydrogen peroxide adducts of pyrophosphates. Such generators readily release hydrogen peroxide in aqueous solution.

However, such peroxides achieve only moderate bleaching when used by themselves in an aqueous environment. Better results have been achieved when they are used with activators. U.S. Pat. No. 4,756,845 describes the use of certain cyanopyridines (e.g. 2-cyanopyridine, 3-cyanopyridine, 4-cyanopyridine, 3-cyano-6-methylpyridine, and 3-cyano-6-ethoxypyridine) and certain cyanopyridinium salts as bleach activators for peroxide containing compounds. The disclosure of this patent, and of all other publications referred to herein, are incorporated by reference as if fully set forth herein.

Unfortunately, activators present their own problems. Some activators are susceptible to sublimation and storage instability. Others are expensive to produce or are highly toxic.

Thus, a need exists for improved activators for peroxide bleaching systems.

DISCLOSURE OF INVENTION

In one aspect, the invention provides a bleaching system. There is a peroxide and an activator selected from the group consisting of a cyanopyridine N-oxide of the formula:

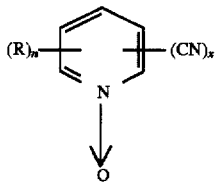

The R is an alkyl group, alkoxy group, organic acid (e.g. —$CO_2H$), amide (e.g. —$CONH_2$), an ester (e.g. —$CO_2R'$)or sulfonate anion (e.g. —$SO_3$). In each case, the R or R' moiety has less than seven carbons. The n is from 0 to 4, x is from 1 to 5, the sum of n and x is from 1 to 5, and each R is independently selected for each n if n is greater than 1.

The bleaching system operates best at neutral to an alkaline pH, generally about pH 7 to pH 12, preferably between pH 8 and pH 11. Many known inorganic and organic bases can be added to provide the alkalinity. Preferred bases include, but are not limited to, alkali metal hydroxides, alkali metal carbonates, alkali metal borates, alkali metal phosphates, alkali metal organocarboxylates (such as trisodium citrate or sodium polyacrylate), alkali metal silicates, and ammonia.

In one form, the peroxide is selected from the group consisting of hydrogen peroxide, tertiary alkyl hydroperoxides, monopersulfates, percarbonates, perborates, and hydrogen peroxide adducts of pyrophosphates, urea, and sodium silicates, and mixtures thereof. The activator is selected from the group consisting of 4-cyanopyridine N-oxide, 3-cyanopyridine N-oxide, and 2-cyanopyridine N-oxide.

The peroxide is preferably 0.1% to 10% by weight in the bleaching solution (e.g. 0.5% to 5%). The activator is preferably 0.1% to 10% by weight in the bleaching solution (e.g. 0.25% to 2.5%). The alkalinity agent is preferably from 0.1% to 20% by weight in the bleaching solution.

A surfactant such as an anionic surfactant or a non-ionic surfactant can also be used with such bleaching systems, as can be a chelating agent such as EDTA, a solvent such as glycol ether, and a fragrance.

The activators (e.g. 4-cyanopyridine N-oxide) are preferably used with solid peroxide generators (e.g. sodium perborate mono/tetra hydrate, sodium percarbonate) when utilized in a single powder composition or a single tablet, which can be combined with water.

As an alternative, and within the meaning of the term "bleaching system", the activator and the peroxide can be separately stored. In one container (or one chamber of a multi-chambered vessel) there can be an alkaline stabilized solution of hydrogen peroxide (e.g. sold commercially as Solvay Interox Peroxyclean grade hydrogen peroxide), and in another container (or a second chamber of the multi-chambered vessel) the activator can be stored in an aqueous solution that is mildly acidic or essentially neutral (e.g. pH 4–8). Suitable multi-chambered vessels are described in U.S. Pat. No. 5,398,846 to Corba et al. Alternatively, the activator can be stored in one container in a mildly alkaline base solution (e.g. with the addition of fully neutralized polyacrylic acid, sodium polyacrylate), and hydrogen peroxide can be stored in a separate container and be a commonly available grade of stable mildly acidic hydrogen peroxide. In another embodiment, one element can be a powder, the other a liquid. In a further embodiment, one element can be a tablet, the other a liquid.

In yet another form, the invention provides a method of bleaching a stain that is present on a surface. (The above bleaching system in a solution that is between pH 7 and pH 12 (preferably 8 and 11) is applied to a stained substrate). Activation of the peroxide is believed to occur via reaction of the activator with peroxide (usually in the form of hydrogen peroxide or a hydroperoxy anion) to generate a peroxycarboximidic acid in the solution, which in turn more effectively bleaches the stain than the peroxide alone would have. Of background interest see generally G. Payne, et al., Journal of Organic Chemistry, Reactions Of Hydrogen Peroxide, Alkali-Catalyzed Epoxidation And Oxidation Using A Nitrile As Co-Reactant, Volume 26, 659–663 (1961).

In addition to the specific activators listed above, the claims are intended to also cover activators with multiple cyano groups around the pyridine ring. Also, lower alkyl substituted (e.g. 2-methyl-4-cyanopyridine N-oxide) and lower alkoxy substituted (e.g. 2-ethoxy-4-cyanopyridine N-oxide) are intended to be within the scope of the claims. Note that each of the positions (other than the N) on the pyridine ring can have a cyano group and/or one of the other R substitutions; provided that there must be at least one cyano group.

The peroxide and the activator are preferably mixed in a molar ratio from about 20:1 to 1:2, with the most preferred embodiments having a slight excess of the peroxide (e.g.

about a 2:1 ratio). When water is pre-added (e.g. when the activator and generator are separately stored as aqueous solutions), it is preferred to use purified water (e.g. deionized water) to avoid the inclusion of transition metal ions.

A wide variety of surfactants may be employed in the present invention such as anionic, non-ionic, amphoteric and cationic surfactants, and mixtures thereof. Generally, the surfactant is substantially stable in the presence of peroxides at or near ambient temperatures of about 25°–40° C. Suitable anionic surfactants include alpha olefin sulfonates, the alkyl aryl sulfonic acids and their alkali metal and alkaline earth metal salts such as sodium dodecyl benzene sulfonate, magnesium dodecyl benzene sulfonate, disodium dodecyl benzene disulfonate and the like, as well as the alkali metal salts of fatty alcohol esters of sulfuric and sulfonic acids and soaps such as sodium stearate.

Non-ionic surfactants include the ethylene oxide ethers of alkyl phenols such as (nonylphenoxy) polyoxyethylene ether, the ethylene oxides ethers of fatty alcohols such as tridecyl alcohol polyoxyethylene ether, the propylene oxide ethers of fatty alcohols, the ethylene oxide esters of acids such as the polyethylene glycol ester of lauric acid, the ethylene oxide ethers of fatty acid amides, the condensation products of ethylene oxide with partial fatty acid esters of sorbitol such as the lauric ester of sorbitan polyethylene glycol ether, and other similar materials.

Amphoteric surfactants include the fatty imidazolines, such as 2-coco-1 hydroxyethyl-1carboxymethyl-1hydroxylimidazoline and similar compounds made by reacting monocarboxylic fatty acids having chain lengths of 10 to 24 carbon atoms with 2-hydroxy ethyl ethylene diamine and with monohalo monocarboxylic fatty acids.

An additional class of surfactants are amine oxides which demonstrate cationic surfactant properties in acidic pH and non-ionic surfactant properties in alkaline pH. Example amine oxides include dihydroxyethyl cocamine oxide, tallowamidopropylamine oxide and lauryl dimethylamine oxide.

See also the surfactants listed in U.S. Pat. No. 4,756,845.

Various solvents in addition to water may be employed in the present invention. These include glycol ethers, such as those derived from $C_1$ to $C_6$ alcohols and ethylene oxide (e.g., the Cellosolve and Carbitol glycol ethers sold by Union Carbide Corporation) or those derived from $C_1$ to $C_4$ alcohols and propylene oxide (e.g. the Arcosolv propylene glycol ethers sold by the ARCO Chemical Company). Other solvents include (but are not limited to) monohydric alcohols, such as ethanol or isopropanol, or polyhydric alcohols such as propylene glycol or hexylene glycol.

The bleaching system described herein may also contain chelating agents to suppress wasteful decomposition of hydrogen peroxide and activated peroxide by transition metal ions. The chelating agents may include (but are not limited to) aminocarboxylates such as those sold under the Versene, Versenol, and Versenex tradenames by the Dow Chemical Company (e.g. $Na_4EDTA$), and aminophosphonates such as those sold under the Dequest trade name by the Monsanto Company. Other chelating agents of utility include the carboxylate bases derived from picolinic acid, dipicolinic acid, glucoheptonic acid, or gluconic acid.

The invention can bleach out a wide variety of organic stains on a plethora of surfaces. As noted below, it is particularly effective in bleaching out beverage stains on cloth or discolorations due to mold growth on ceramic tile. However, the stains can also be present on other hard or soft surfaces such as carpets, upholstery, floors, walls, countertops, and the like.

The present invention provides a laundry stain remover on soft surfaces such as laundry, upholstery, and carpeting, a hard surface bathroom and kitchen cleaner, and as a stain remover for other applications.

The objects of the present invention therefore include providing a bleaching system of the above kind:

(a) having desirable stability characteristics;

(b) having excellent stain removal capability for a wide variety of stains on a wide variety of surfaces;

(c) which is relatively inexpensive to produce; and (d) which uses environmentally acceptable components.

These and still other objects and advantages of the present invention (e.g. methods for using such bleaching systems) will be apparent from the description which follows. The following description is merely of the preferred embodiments. Thus, the claims should be looked to in order to understand the full scope of the invention.

BEST MODES FOR CARRYING OUT THE INVENTION

Mold Stain Bleaching: Ceramic Tile Experiments

Figure 1:
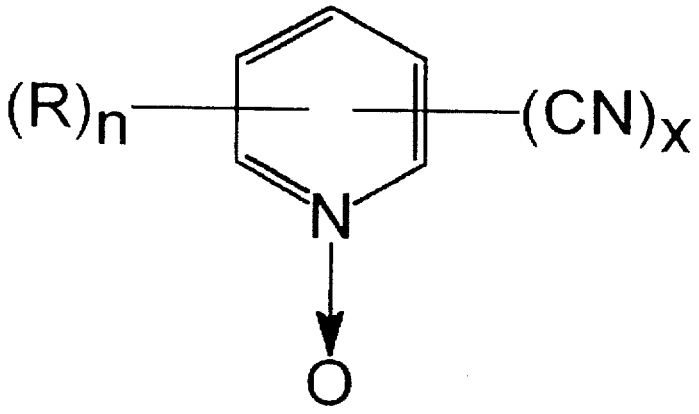
FIG. 1 is a formula for activators of the present invention.
Figure 2:
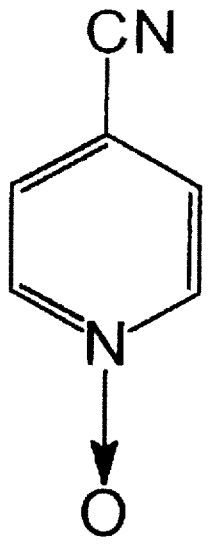
FIG. 2 is a formula for 4-cyanopyridine N-oxide.

Solution A (pH 4.59) is 7.50 g 4-cyanopyridine N-oxide, 291 g deionized $H_2O$, and 1.50 g Shell Neodol® R1-7 ethoxylated alcohol.

Solution B is 6% $H_2O_2$ (alkaline stabilized, Solvay Interox, pH 9.0).

The first two experiments that are described below mix alkaline hydrogen peroxide from one container with an acidic activator/surfactant mix from a second container:

Experiment 1

10.0 g of Solution A was mixed with 10.0 g of Solution B. A 1 ml sample of the resulting mixture (pH 7.89) was quickly pipetted onto one-half of a 2"×2" (about 5.08 cm×5.08 cm) dried mold stained ceramic tile (stained a medium brown color by applying an aspergillus niger mold spore suspension). The treated section of the tile was bleached white within 30 seconds.

Experiment 2

10.0 g of Solution A was mixed with 10.0 g of Solution B. A 1.5 ml sample of mixture was quickly applied to a 2"×2" (about 5.08 cm×5.08 cm) mold stained tile where brown aspergillus niger mold colonies had been cultured on the tile surface. The tile was bleached completely white within two minutes of application.

The next experiment confirmed that conventionally stabilized (slightly acidic) hydrogen peroxide can be effectively used with an alkaline solution of the activator:

Experiment 3

8.50 g of Solution A was mixed with 1.50 g of B. F. Goodrich Goodrite K-7200N neutralized sodium polyacrylate. The pH of this resulting solution (Solution A') was 8.76. It was then added to 10.0 g of 6% $H_2O_2$ (pH 3.96) to yield a combined solution having a pH of 7.75.

The above mixture was then applied to the same types of stained tiles as in Experiments 1 and 2. The treated sections of tile were bleached white within less than a minute.

Control A

In this experiment, we omitted the activator. We used 10.0 g of Solution B with 0.1 g of Neodol® R1-7 surfactant and 9.9 g of water. A 1.5 ml sample of the resulting mixture (pH 9.15) was quickly pipetted onto the same types of stained tiles as in Experiments 1 and 2. Even after one hour, the tiles remained a light brown color. Thus, in the absence of the activator the peroxide provided only very weak bleaching.

Control B

In this experiment, we omitted the peroxide. We used 10.0 g of Solution A with 10 g of water. A 1 ml sample of the resulting mixture was pipetted onto the same types of stained tiles as in Experiments 1 and 2. Even after one hour, the tiles remained their initial medium brown color. Thus, in the absence of the peroxide, the activator provided essentially no bleaching.

Stain Cloth Bleaching Experiments

The next set of experiments evaluated the cyanopyridine N-oxide activator systems on tea stained cotton cloth. These bleaching experiments were conducted at ambient room temperature (about 23° C.) in 1000 ml glass beakers, using 500 g of total bleaching solution and a single 4"×10" (about 10.2 cm×25.4 cm) swatch of BC-3 tea stained cotton cloth (Testfabrics Inc., Middlesex, N.J.). All bleaching experiments were conducted for 15.0 minutes.

The tea stained swatches were colorimetrically evaluated before and after bleaching with a Minolta CR-310 chroma meter (5 cm. diameter measuring port) using CIE L,a,b color scale determinations. Bleaching performance was measured as the total color difference before and after bleaching, Delta $E=((\text{Delta } L)^2+(\text{Delta } a)^2+(\text{Delta } b)^2)^{1/2}$. Total color difference measurements were also obtained for the bleached swatches relative to a standard white cotton cloth to demonstrate total color differences between the bleached swatches and an unstained white cloth, referred to as herein as Delta $E_w$. Four Delta E and Delta $F_w$ measurements were made per stained swatch, and the average values reported.

The swatches were immersed in bleaching solution for 15.0 minutes, removed, rinsed in deionized water, air dried 24 hours at room temperature, and then remeasured. For Experiments 4–9 and Representative Controls C–F, the bleaching solutions were prepared as follows:

Experiment 4

5.00 g $Na_2CO_3$ was mixed with 1.70 g 50% $H_2O_2$ (Solvay Interox cosmetic grade), 1.00 g Neodol R1-7 (non-ionic surfactant), 0.05 g Dequest 2066, 2.50 g 4-cyanopyrindine N-oxide, and 489.8 g of deionized $H_2O$. This solution had a pH of 10.22.

Experiment 5

As in Experiment 4, except that the 5.00 g $Na_2CO_3$ was replaced with 2.50 g $Na_2CO_3$+2.50 g $NaHCO_3$. This solution had a pH of 9.49.

Experiment 6

5.00 g $NaHCO_3$ was mixed with 1.70 g 50% $H_2O_2$ (as above), 1.00 g Neodol R1-7, 0.05 g Dequest 2066, 2.50 g 4-cyanopyridine N-oxide, and 489.8 g deionized $H_2O$. This solution had a pH of 7.99.

Experiment 7

As above in Experiment 6, except the 5.00 g $NaHCO_3$ was replaced with 5.00 g of $Na_2B_4O_7 \cdot 10\ H_2O$ (sodium tetraborate decahydrate). This solution had a pH of 9.02.

(Note that Experiments 8 & 9 are examples of hydrogen peroxide being supplied by solid peroxide generators.)

Experiment 8

5.00 g sodium percarbonate was mixed with 1.00 g Neodol® R1-7, 0.05 g Dequest 2066, 2.50 g 4-cyanopyridine N-oxide, and 491.5 g deionized H2O. This solution had a pH of 10.00.

Experiment 9

As in Experiment 9, except that 5.00 g of sodium perborate monohydrate was used in place of the sodium percarbonate. This solution had a pH of 9.68.

Control C 5.00 g of sodium percarbonate was mixed with 1.00 g Neodol R1-7, 0.05 g Dequest 2066, and 494.0 g of deionized $H_2O$. This solution had a pH of 10.62.

Control D

As above in Control C, except the 5.00 g of sodium percarbonate is replaced with 5.00 g of sodium perborate monohydrate. This solution had a pH of 10.20.

Control E 5.00 g of $Na_2CO_3$ was mixed with 2.50 g of 4-cyanopyridine N-oxide, 1.00 g of Neodol R1-7, 0.05 g of Dequest 2066, and 491.5 g of deionized $H_2O$. This solution had a pH of 11.26.

Control F

As above in Control E except the 5.00 g of $Na_2CO_3$ is replaced with 5.00 g of $Na_2B_4O_7 \cdot 10H_2O$. This solution had a pH of 9.23.

TABLE I

Before And After Comparison

| Experiment | Average Delta E (ΔE) |
|---|---|
| 4 | 20.09 |
| 5 | 20.95 |
| 6 | 19.62 |
| 7 | 15.42 |
| 8 | 20.43 |
| 9 | 18.18 |
| Control C | 8.87 |
| Control D | 4.96 |
| Control E | 0.98 |
| Control F | 1.14 |

TABLE II

Treated Swatches Compared To Standard White Cloth

| Experiment # | Average Delta $E_w$ ($\Delta E_w$) |
|---|---|
| 4 | 11.07 |
| 5 | 10.29 |
| 6 | 11.77 |
| 7 | 16.05 |
| 8 | 10.68 |
| 9 | 13.34 |
| Control C | 21.11 |

TABLE II-continued

| Treated Swatches Compared To Standard White Cloth | |
|---|---|
| Experiment # | Average Delta $E_w$ ($\Delta E_w$) |
| Control D | 24.19 |
| Control E | 27.72 |
| Control F | 26.88 |

As shown in Table I above, the ΔE values obtained in Experiments 4–9 are much greater than those obtained for the Controls controls C–F, indicating a much greater total color change for the tea stained BC-3 swatch when treated with a bleaching solution containing both peroxide and 4-cyanopyridine N-oxide activator at neutral to alkaline pH. Similarly, the $\Delta E_w$ valves shown in Table II are much smaller for Experiments 4–9, in comparison to Controls C–F, indicating that a bleaching solution containing both 4-cyano pyridine N-oxide activator and peroxide at neutral to alkaline pH more effectively brings the tea stained BC-3 swatch closer in appearance to the white cotton reference swatch.

The bleaching systems were much less effective in experiments in which the final solution had an acidic pH. The preferred pH range for the bleach is between about pH 7 and pH 12, especially between pH 8 and pH 11.

It should be appreciated that the above discussion merely relates to several preferred forms of the invention. Other forms of the invention are also possible. The bleaching system can be stored as a single powder composition, much as a kitchen cleanser would be (e.g. sodium percarbonate, 4-cyanopyridine N-oxide, a conventional abrasive and surfactant). Alternatively, it can be stored in two separate containers, at least one of which is alkaline.

While the use of 4-cyanopyridine N-oxide is preferred, various other activators of the general formula:

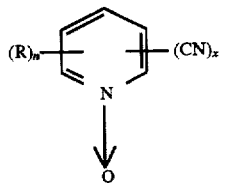

are also within the claims.

Industrial Applicability

A kitchen cleanser can be formulated from solid powders of the bleaching system. When water is added after the cleanser is sprinkled on a stained surface (e.g. a moistened sponge is applied on top of powder that has been positioned on the surface), hydrogen peroxide is generated in place, and the activator can react with it to create more effective peroxycarboximidic acid bleaching agents.

Another application is as a laundry stain remover. The powders (or liquids) can be used to create a liquid concentrate that can be poured directly on the stain.

Various other cleaning and bleaching uses are intended.

I claim:

1. A bleaching system, comprising a surfactant selected from the group consisting of anionic, non-ionic, amphoteric and cationic surfactants, as well as mixtures thereof; 0.1 to 10 weight % of a peroxide; and 0.1 to 10 weight % of an activator selected from the group consisting of a cyanopyridine N-oxide of the formula:

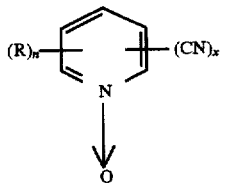

wherein R is selected from the group consisting of alkyl moiety, organic acid moiety, amide moiety, ester moiety, alkoxy moiety, and sulfonate moiety (wherein each such moiety has less than seven carbons), n is from 0 to 4, x is from 1 to 5, the sum of n and x is from 1 to 5, and each R is independently selected for each n if n is greater than 1.

2. The bleaching system of claim 1, further comprising a base selected from the group consisting of alkali metal hydroxide, alkali metal carbonate, alkali metal borate, alkali metal phosphate, alkali metal organocarboxylate, alkali metal silicate, and ammonia.

3. The bleaching system of claim 1, wherein the peroxide is selected from the group consisting of hydrogen peroxide, tertiary alkyl hydroperoxides, monopersulfates, percarbonates, perborates, hydrogen peroxide adducts of pyrophosphates, urea and sodium silicates, and mixtures thereof.

4. The bleaching system of claim 1, wherein the activator is selected from the group consisting of 4-cyanopyridine N-oxide, 3-cyanopyridine N-oxide, and 2-cyanopyridine N-oxide.

5. The bleaching system of claim 1, further comprising a chelating agent.

6. The bleaching system of claim 1, wherein the activator and peroxide are separately stored.

7. The bleaching system of claim 1, further comprising a solvent selected from the group consisting of glycol ethers, monohydric alcohols, and polyhydric alcohols.

8. A method of bleaching a stain that is present on a surface, comprising applying the bleaching system of claim 1 to the stain in an aqueous solution that is between about pH 7 and pH 12.

9. The method of claim 8, wherein the pH of the aqueous solution is between pH 8 and pH 11.

* * * * *